United States Patent [19]

Ide

[11] Patent Number: 4,810,170

[45] Date of Patent: Mar. 7, 1989

[54] JET PUMP

[76] Inventor: Russell D. Ide, P.O. Box 744, Coventry, R.I. 02816

[21] Appl. No.: 152,341

[22] Filed: Feb. 4, 1988

[51] Int. Cl.[4] ..... F04F 5/00

[52] U.S. Cl. ..... 417/194; 417/187; 417/198

[58] Field of Search ..... 417/171, 181, 182, 187, 417/194, 198

[56] References Cited

U.S. PATENT DOCUMENTS

| | | | |
|---|---|---|---|
| 92,313 | 7/1869 | Hughes | 417/187 |
| 857,920 | 6/1907 | Boekel | 417/198 |
| 995,969 | 6/1911 | Junk | 417/181 |
| 1,040,641 | 10/1912 | Coyle | 417/198 |

FOREIGN PATENT DOCUMENTS

| | | | |
|---|---|---|---|
| 161290 | 2/1955 | Australia | 417/194 |
| 223896 | 7/1910 | Fed. Rep. of Germany | 417/194 |
| 897090 | 5/1944 | France | 417/187 |
| 40500 | 2/1986 | Japan | 417/187 |
| 585318 | 12/1977 | U.S.S.R. | 417/187 |

*Primary Examiner*—Carlton R. Croyle
*Assistant Examiner*—Eugene L. Szczecina, Jr.
*Attorney, Agent, or Firm*—Barlow & Barlow, Ltd.

[57] ABSTRACT

A jet pump has a chamber with a jet nozzle at the inlet port and a diffuser fitted into the outlet port with a suction port fitted in the chamber. A ball valve having a passage therethrough is fitted ahead of the jet nozzle and angular rotation of the ball valve creates a swirling action in the jet nozzle and adjustment thereof will provide maximum pumping action for various operating conditions.

3 Claims, 1 Drawing Sheet

JET PUMP

BACKGROUND OF THE INVENTION

The general utilization of the Venturi action for causing suction by the passage of fluid through nozzles is well known and documented in literature and generally, the articles as commonly used are composed of a water supply pipe, an air inlet pipe and outlet pipe which is in line with the inlet pipe. There has also been some improvement upon the basic concept and the inlet water has been given an rotary motion generally by the utilization of some form of spiral deflector as seen for example in the early patent to Boekel, U.S. Pat. No. 857,920. There have, of course, been other modifications by generally changing the manner in which the inlet water is swirled and a modification attached to a standard water spigot is seen in Junk, U.S. Pat. No. 995,969.

SUMMARY

It is the principal object of the present invention to provide a jet pump in which the fluid is caused to flow smoothly through the pump and in which the efficiency or amount of suction that the pump delivers can be readily controlled by the user.

A further object of the invention is to provide a low cost adjustable means to vary swirl turbulence to improve pumping capability at various supply pressures and flows.

According to the invention, a ball valve having a cylindrical conduit therethrough is fitted at inlet port ahead of the jet nozzle and the ball valve not only adjusts the flow but also is set so that the conduit therethrough is at a angle to the axial extent of the inlet port. This causes the fluid to swirl as it flows through the jet nozzle and into the diffuser which is coaxial with the nozzle and is fitted into the outlet port of the pump chamber. The swirling of the fluid improves the entrapment of air or fluid entering the suction tube and increases the vacuum in the suction line. As the fluids enter the diffuser, they become further mixed and the flow becomes laminar at the diffuser outlet. The pump therefore consists essentially of a chamber that has a tubular inlet port and a tubular outlet port that are in axial alignment with the usual jet nozzle fitted into the inlet port and a diffuser fitted into the outlet port and, as indicated previously, a ball valve is fitted at the inlet port.

DESCRIPTION OF THE PREFERRED EMBODIMENT

Figure 1:
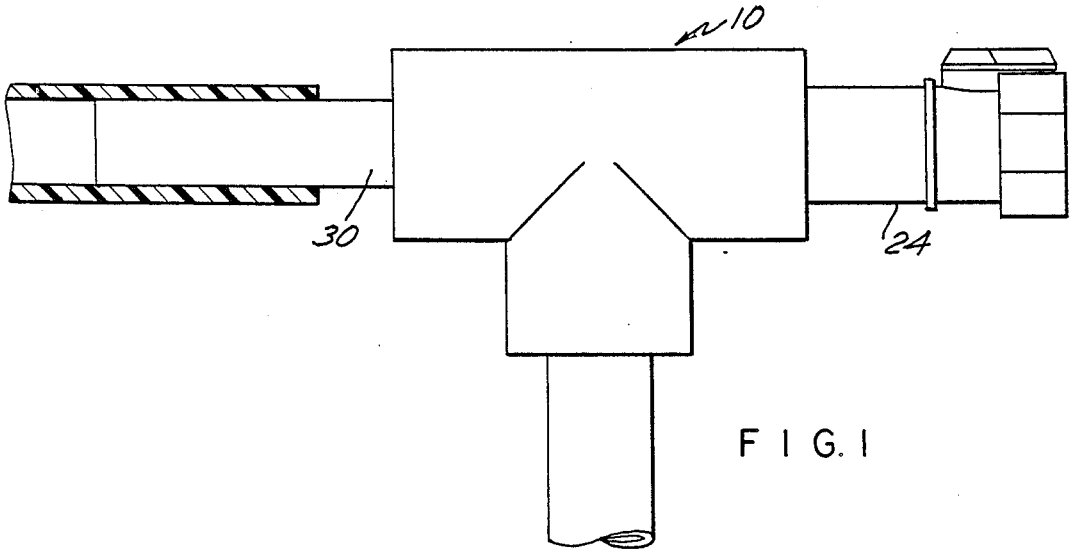
FIG. 1 is an elevational view showing my improved jet pump.
Figure 2:
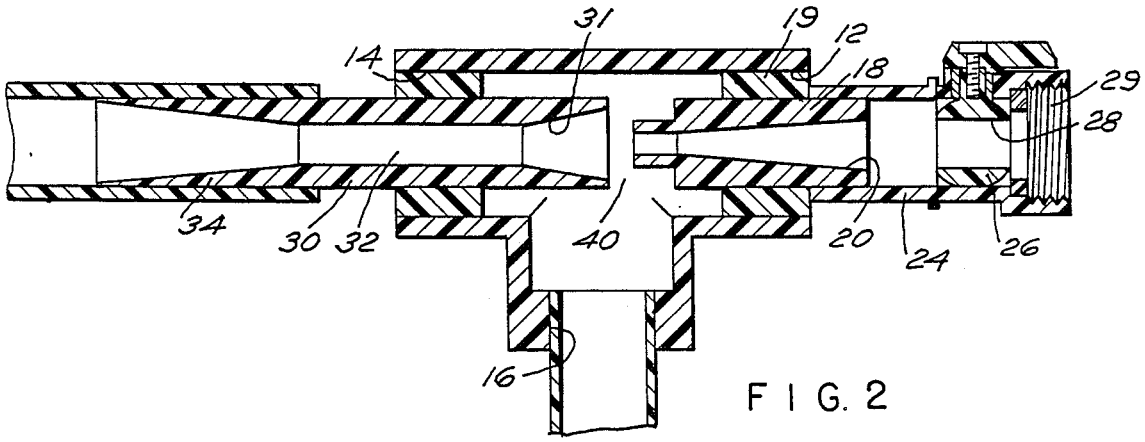
FIG. 2 is a central sectional view therethrough showing the internal parts.

In the apparatus illustrated in the drawings, there is shown a housing assembly 10 defining a chamber which housing is a conventional molded "T" fitting which essentially has an inlet port 12 and an outlet port 14 that define a first through passage together with a suction port 16 that defines a passage at right angles to the first passage. Fitted into the inlet port 12 is a jet nozzle 18 which may be welded into the inlet nozzle 12 by utilizing a bushing 19. The jet nozzle 18 essentially consists of a tubular member with a central bore 20 that decreases in internal diameter from the point where the fluid enters. On the outer end of the nozzle, a coupling 24 is fitted and within this coupling member is a ball valve 26 having a cylindrical passage 28 therethrough. The ball valve is rotatable in a manner known to those skilled in the art and coupling member 24 has for convenience sake, a threaded hose inlet as at 29.

The outlet port 14 is fitted with a diffuser 30, the inner opening of the diffuser tube at 31 being in line with the outlet of the jet 18 with a space between them as illustrated. The diffuser is formed with a passage way 32 which is outwardly flared at both ends and the outer end thereof at 34 protrudes from the main chamber sufficiently to allow a discharge hose to be fitted thereover easily and carry the fluid to a suitable outlet source.

Figure 3:
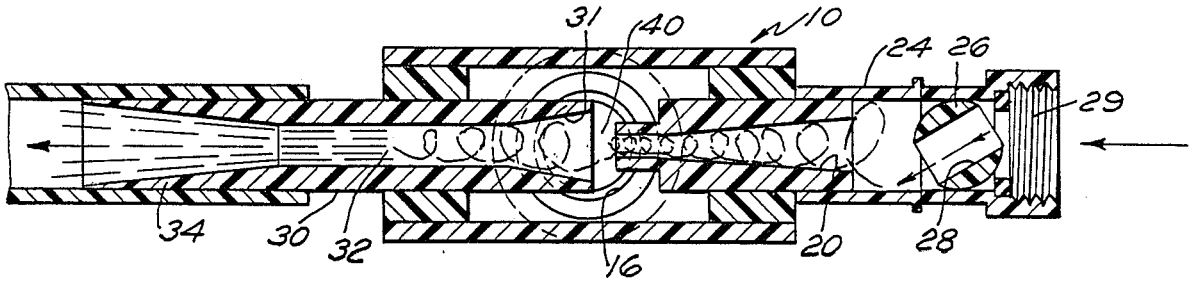
FIG. 3 is a top sectional view illustrating diagrammatically the action of the pump.

Referring to FIG. 3, there has been diagrammatically illustrated the manner in which the jet pump operates. According to the principle of the instant invention, the ball valve is rotated at an acute angle to the axial extent of the inlet passage way and this causes the fluid to swirl. Swirling of the fluid maximizes turbulence to entrap air and creates a low pressure area at 40 that of course increases the vacuum present at the suction port 16. The swirling, as it continues through the diffuser 30, tends to prevent the fluid from short circuiting back to the low pressure area.

The turbulent mixture with the maximum amount of entrained air is converted back to a laminar flow in the diverging section of the diffuser. The return to laminar flow in the diverging section results in a significant increase in static pressure head that allows the fluid to move through a discharge hose attached to the diffuser. With the subject invention, significant flows have been achieved. Typical pumping capacity exceeds 15 GPM at a one foot head with pressures at the inlet 28 as low as 30 psi.

I claim:

1. A jet pump comprising a housing assembly defining a chamber having a tubular inlet port for motive liquid, and a tubular outlet port in axial alignment, a jet nozzle fitted in the inlet port and having its discharge end within the chamber, a ball valve having a cylindrical passage therethrough disposed in the inlet port spaced from the jet nozzle, the passage through the valve being normally arranged at an acute angle to the axis of the inlet port, a diffuser fitted in the outlet port, and a suction port fitted in said chamber whereby angular rotation of the ball valve to an acute angle with respect to the inlet port creates a swirling motion in liquid passing therethrough, said swirling motion being adjustable by rotation of the ball valve to provide maximum pumping action for various operating conditions.

2. A jet pump as in claim 1 wherein the inlet port has a threaded coupling for attachment to a supply of motive liquid.

3. A jet pump comprising a T-shaped housing defining a through passage and a passage at right angles to the through passage, one end of the through passage receiving a jet nozzle, a coupling having a ball valve therein fitted on the inlet of the jet nozzle, a diffuser tube fitted in the other end of the through passage and spaced from the outlet of the jet nozzle, and a pickup tube fitted into the passage at right angles, said ball valve being normally at an acute angle to the passage whereby motive liquid will impinge on a wall of the passage and create a swirling motion in liquid passing therethrough.

* * * * *